US011193311B2

(12) United States Patent
Grewe et al.

(10) Patent No.: US 11,193,311 B2
(45) Date of Patent: Dec. 7, 2021

(54) PANIC BAR LATCH RELEASE ASSEMBLY

(71) Applicant: Kason Industries, Inc., Newnan, GA (US)

(72) Inventors: Brian Grewe, Mableton, GA (US); Brett A. Mitchell, Newnan, GA (US); Burl M. Finkelstein, Newnan, GA (US)

(73) Assignee: Kason Industries, Inc., Newnan, GA (US)

( * ) Notice: Subject to any disclaimer, the term of this patent is extended or adjusted under 35 U.S.C. 154(b) by 471 days.

(21) Appl. No.: 16/260,182

(22) Filed: Jan. 29, 2019

(65) Prior Publication Data

US 2020/0240179 A1 Jul. 30, 2020

(51) Int. Cl.

| | |
|---|---|
| ***E05B 65/10*** | (2006.01) |
| ***E05B 63/24*** | (2006.01) |
| ***E05B 17/00*** | (2006.01) |

(52) U.S. Cl.

CPC ..... *E05B 65/106* (2013.01); *E05B 65/1006* (2013.01); *E05B 17/0075* (2013.01); *E05B 63/246* (2013.01); *E05B 65/1093* (2013.01); *Y10S 292/65* (2013.01); *Y10T 292/0822* (2015.04); *Y10T 292/0908* (2015.04); *Y10T 292/57* (2015.04)

(58) Field of Classification Search

CPC ..... Y10T 292/57; Y10T 292/0908; Y10T 292/0822; Y10S 292/65; Y10S 292/75; E05B 65/1093; E05B 65/0042; E05B 65/0053; E05B 63/246; E05B 17/0075; E05B 65/106; E05B 65/1006; E05B 65/1066

See application file for complete search history.

(56) References Cited

U.S. PATENT DOCUMENTS

| | | | | | |
|---|---|---|---|---|---|
| 917,685 | A * | 4/1909 | Voight | E05B 65/1006 | 292/92 |
| 1,029,626 | A * | 6/1912 | Palm | E05B 65/1006 | 292/21 |
| 1,130,266 | A * | 3/1915 | Gold | E05B 65/1006 | 292/92 |
| 1,145,590 | A * | 7/1915 | Hurd | E05B 65/1006 | 292/21 |
| 1,345,041 | A * | 6/1920 | Voight | E05B 65/1013 | 292/21 |

(Continued)

*Primary Examiner* — Christine M Mills
*Assistant Examiner* — Faria F Ahmad
(74) *Attorney, Agent, or Firm* — Baker Donelson Bearman Caldwell & Berkowitz

(57) ABSTRACT

A panic bar latch release assembly is disclosed having an inside latch release and an outside pull type handle latch. The handle latch includes a main housing having a pivotal pull handle. The inside latch release includes a first bar mount, a second bar mount, and an elongated push bar. The first bar mount has a support bracket with a floor with a first stop wall and an extended portion with a push rod guide hole extending therethrough. A body portion is coupled to the support bracket which includes a handle mount channel which is partially defined by a second stop wall. A handle mount is pivotally coupled to the body portion. An elongated push rod is positioned within a push rod channel of the door so as to extend through the push rod guide hole.

16 Claims, 4 Drawing Sheets

(56) References Cited

U.S. PATENT DOCUMENTS 1,386,551 A * 8/1921 Bumbarger ..... E05C 3/14 292/195
1,721,489 A * 7/1929 Prinzler ..... E05B 65/1066 292/21
1,815,584 A * 7/1931 Prinzler ..... E05B 65/1066 70/92
2,202,075 A * 5/1940 Yoe ..... E05B 65/1066 70/92
2,320,298 A * 5/1943 Philips ..... E05B 65/1073 292/92
2,415,587 A * 2/1947 Groeger ..... E05B 65/0053 292/173
2,729,486 A * 1/1956 Evans ..... E05B 65/0053 292/92
2,784,022 A * 3/1957 North ..... E05B 65/0053 292/336.3
2,872,233 A * 2/1959 Bordner, Jr. ..... E05B 65/0053 292/92
2,886,363 A * 5/1959 Blumenthal ..... E05B 65/0053 292/92
2,968,506 A * 1/1961 Lade ..... E05B 63/248 292/21
3,073,142 A * 1/1963 Stebbins ..... E05B 65/1066 70/92
3,083,560 A * 4/1963 Scott ..... E05B 65/1066 70/92
3,123,387 A * 3/1964 Jackson ..... E05B 65/1066 292/21
3,214,947 A * 11/1965 Wikkerink ..... E05B 65/1066 70/92
3,334,500 A * 8/1967 Bejarano ..... E05B 65/1013 70/92
3,494,650 A * 2/1970 Slopa ..... E05B 65/0053 292/92
3,583,740 A * 6/1971 Armstrong ..... E05B 65/1013 292/198
3,593,550 A * 7/1971 Berkowitz ..... E05B 65/0042 70/207
3,645,572 A * 2/1972 McFarlane ..... E05B 13/002 292/21
3,873,141 A * 3/1975 Peterson ..... E05B 65/1066 292/40
3,897,092 A * 7/1975 Atkins ..... E05B 65/1066 292/92
3,940,886 A * 3/1976 Ellingson, Jr. ..... E05B 65/1013 49/319
3,993,335 A * 11/1976 Schmidt ..... E05B 63/20 292/21
4,009,537 A * 3/1977 Hubbard ..... E05B 65/1066 49/319
4,145,900 A * 3/1979 Ohno ..... E05B 65/104 292/92
4,204,369 A * 5/1980 Hubbard ..... E05B 65/1066 292/21
4,280,725 A * 7/1981 Berkowitz ..... E05B 65/0042 292/223
4,372,591 A * 2/1983 Cook ..... E05B 65/0053 292/1
4,382,620 A * 5/1983 Horgan, Jr. ..... E05B 65/106 292/336.3
4,480,451 A * 11/1984 Fujiya ..... E05B 65/0053 292/21
4,488,378 A * 12/1984 Symon ..... E05B 65/1066 292/21
4,519,641 A * 5/1985 Fujiya ..... E05B 65/0053 292/126
4,530,532 A * 7/1985 Fujiya ..... E05B 63/246 292/341.15
4,635,977 A * 1/1987 Yamada ..... E05B 65/0053 292/92
4,704,882 A * 11/1987 Takasaki ..... E05C 1/14 70/215
4,714,282 A * 12/1987 Henderson ..... E05B 65/1066 292/36
4,895,399 A * 1/1990 Horgan, Jr. ..... E05B 65/1073 292/336.3
4,986,583 A * 1/1991 Campbell ..... E05B 65/104 292/165
5,054,825 A * 10/1991 Mangin ..... E05B 65/1066 292/92
5,088,786 A * 2/1992 Linder ..... B01D 53/8628 292/92
5,114,192 A * 5/1992 Toledo ..... E05B 63/20 292/21
5,504,974 A * 4/1996 Graber ..... B60J 5/0487 16/438
5,547,235 A * 8/1996 Dziuk ..... E05B 65/1066 292/336.3
5,582,443 A * 12/1996 Finkelstein ..... E05B 13/108 292/202
5,947,534 A * 9/1999 Zarzycki, Jr. ..... E05B 65/1073 292/92
6,145,897 A * 11/2000 Locher ..... E05B 65/1053 292/168
6,641,183 B2 * 11/2003 Brown ..... E05B 65/1013 292/92
6,953,211 B2 * 10/2005 Di Vinadio ..... E05B 65/1066 292/296
9,068,376 B2 * 6/2015 Mitchell ..... E05B 63/246
9,995,060 B2 * 6/2018 Miller ..... E05B 65/10
10,662,671 B2 * 5/2020 Stallbaumer ..... E05C 3/042
2010/0109352 A1 * 5/2010 Tien ..... E05B 65/1006 292/336.3

* cited by examiner

PANIC BAR LATCH RELEASE ASSEMBLY

TECHNICAL FIELD

This invention relates to latch releases, and specifically to an interior latch release in the form of an elongated bar.

BACKGROUND OF INVENTION

Walk-in cold rooms, such as walk-in coolers, freezers, or other refrigerated environments, are common in various industries, including supermarkets and grocery stores, commercial kitchens, and other food service facilities. They typically have one or more access doors for entry and exit from the environment.

A problem associated with a cold-room door is the possibility that a person may become enclosed within the cold-room. To resolve this potential problem the door is provided with an inside release designed to release the latch on the opposite side of the door. The inside release may be in the form of a knob having a threaded rod which mounts the latch to the cold room door. A problem with this type of device is that a person in a panicked state within the cold room may not realize that turning the internal knob releases the latch and allows egress from the cold-room.

Another problem with these type of releases is that some people may not have the hand strength or dexterity to turn a tightened knob type release.

Some bar type latches have been designed which allow a person to simply push upon an elongated horizontal bar to operate a latch. These types of bar latches operate by directly actuating the release mechanism of the latch, i.e., the bar is directly coupled to the strike which prevents the opening of the door. This type of bar latch is shown in U.S. Pat. Nos. 5,947,534; 5,547,235; 3,897,092, and 2,320,298.

These types of bar latches directly operate the strike through linkage which may become inoperable over time due to wear.

Accordingly, it is seen that a need exists for a panic bar latch release which is easier for people to recognize and operate. It is to the provision of such therefore that exemplary embodiments of the present invention are primarily directed.

SUMMARY OF INVENTION

A panic bar latch assembly coupleable to a door comprises an exterior handle latch having a pivotal handle, an interior latch release having two bar mounts coupled to the door, an elongated push bar extending between the two bar mounts which is pivotally coupled to the two bar mounts, and a push rod having a first end operatively coupled to the pivotal handle and an oppositely disposed second end operatively coupled to one bar mount of the two bar mounts. With this construction, the pivotal movement of the push bar causes the push rod to pivotally bias the handle of the exterior handle latch.

DETAILED DESCRIPTION

Figure 1:
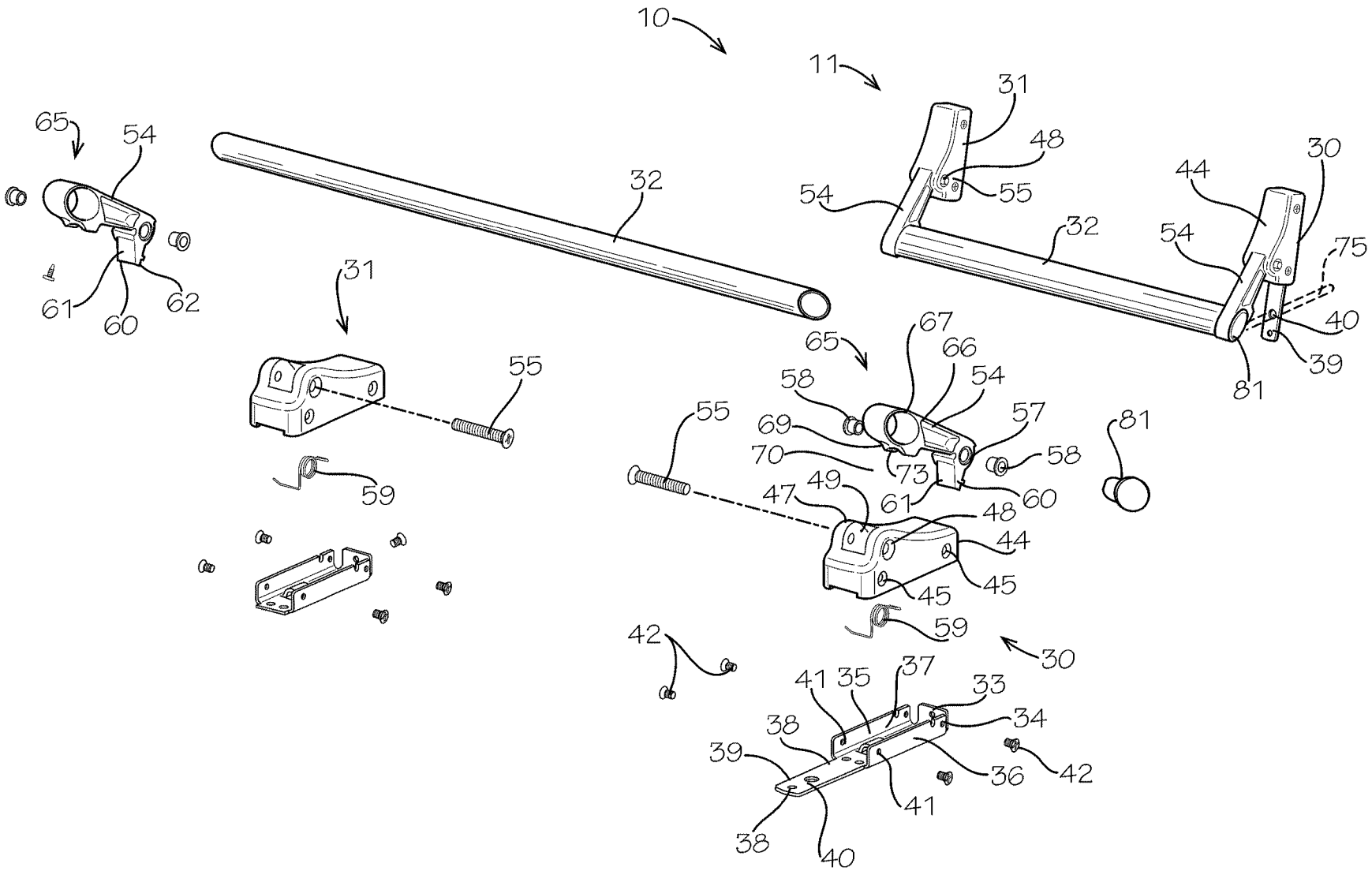
FIG. 1 is a perspective view of a panic bar latch release assembly.

With reference to the drawings, there is shown a panic bar latch release assembly 10 for walk-in cold rooms according to the present invention. The panic bar latch release assembly 10 includes an interior or inside latch release 11, mounted to an inside surface of the door and which is used in conjunction with an exterior or outside pull type handle latch 12 mounted to a outside surface of the door D of a walk-in cold room within a surrounding wall to control and/or restrict opening of the door D and access the walk-in cold room.

The pull type handle latch 12 includes a main housing 15 having a lever type pull handle 16 pivotally coupled to the main housing 15. The pull handle 16 is coupled to linkage 17 which moves a pivotal latch bolt 18. The linkage 17 includes a push rod contact plate 21 which is aligned with a latch opening 22 extending from a door contact surface 23 of the latch 12.

Figure 3:
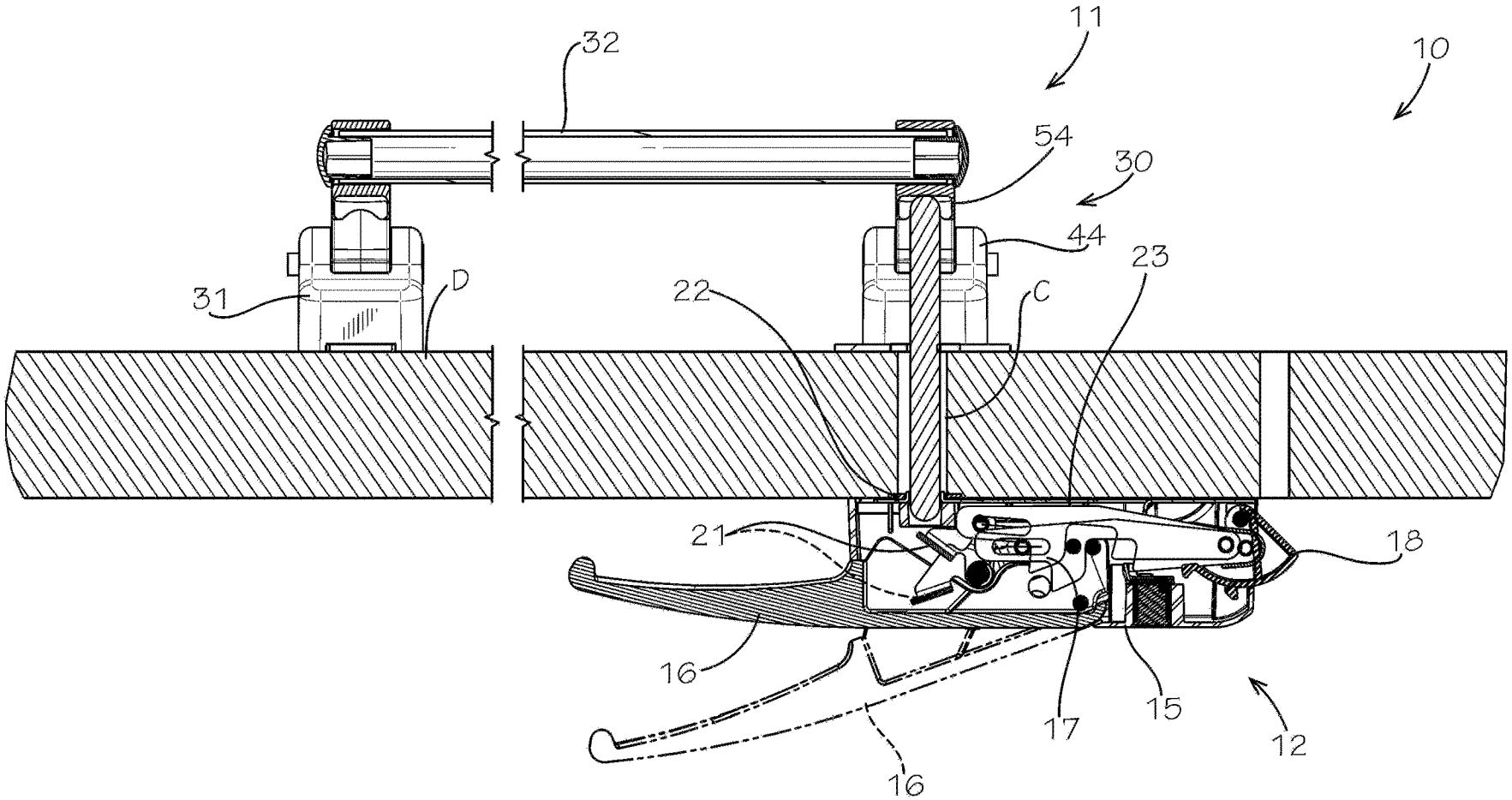
FIG. 3 is a cross-sectional top view of the panic bar latch release assembly shown in FIG. 1, shown mounted to a door.
Figure 4:
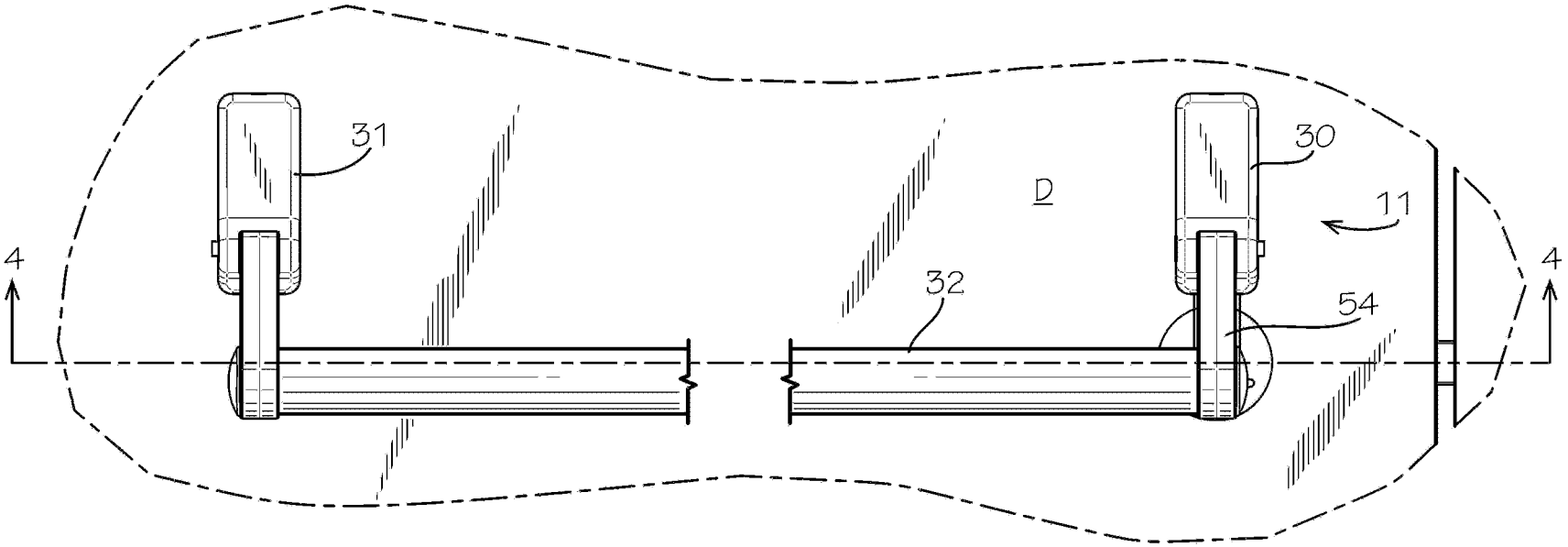
FIG. 4 is a front view of the panic bar latch release assembly shown in FIG. 1.

The latch opening 22 and push rod contact plate 21 are aligned with a push rod channel C extending through the door D between its exterior surface and the interior surface. The handle 16, linkage 17, latch bolt 18 and push rod contact plate 21 are movable between a locked or latched position and an unlocked or unlatched position shown in broken lines in FIG. 3.

The inside latch release 11 includes a first bar mount 30, a second bar mount 31, and an elongated push bar 32 coupled to and extending between the first bar mount 30 and the second bar mount 31. The first and second bar mounts 30 and 31 are mounted to the interior surface of the door D.

The first bar mount 30 has a support bracket 34 with a floor 35, two oppositely disposed side walls 36 and an end wall 33 extending from the floor 35. The floor 35 has screw mounting holes 38 through which mounting screws extend to mount the support bracket 34 to the door D.

The floor 35 has a raised middle portion which creates a first stop, stop wall or tongue 37. The floor 35 also has an extended portion or plate 39 with a push rod guide hole 40 extending therethrough. The push rod guide hole 40 is aligned with the push rod channel C.

The first support bracket side walls 36 have screw mounting holes 41 which are threaded to received threaded mounting screws 42.

A cover or body portion 44 is coupled to the support bracket 34. The body portion 44 has mounting holes 45 which are aligned with the support bracket screw mounting holes 41. Mounting screws 42 pass through the mounting holes 45 and are threadably received within screw mounting holes 41 to lock or fix the body portion 44 to the support bracket 34.

Figure 2:
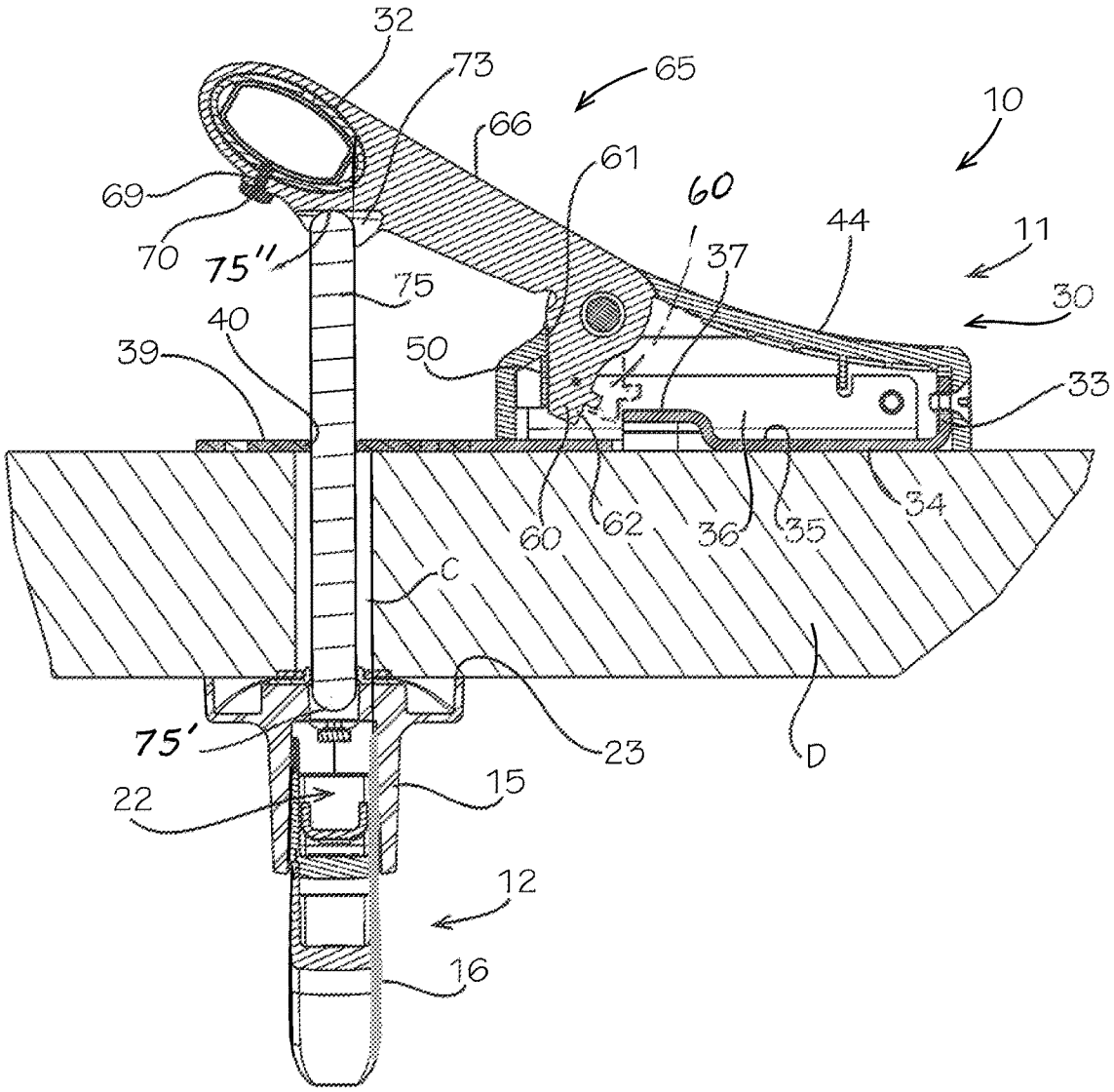
FIG. 2 is a cross-sectional side view of the panic bar latch release assembly shown in FIG. 1, shown mounted to a door.

The body portion 44 also includes two mounting bolsters, seats, or flanges 47 having pivot pin mounting holes 48 therethrough. A handle mount channel 49 extends between the two mounting flanges 47 and into the body portion 44. The handle mount channel 49 is partially defined by a second stop or stop wall 50, as best shown in FIG. 2.

A handle mount 54 is pivotally coupled to the body portion 44 through a pivot pin 55 which extends through a pivot pin mounting hole 57 extending through the handle mount 54 and the pivot pin housing holes 48 of the body portion 44. The pivot pin housing holes 48 may be fitted with a pair of bushings 58 therein to provide easier movement between the pivot pin 55 and the handle mount 54. A coil spring 59 is journalled upon the pivot pin 55 and coupled between the handle mount 54 and body portion 44 so as to bias the handle mount 54 towards its outwardly extending, unengaged position.

The handle mount 54 includes a stop portion, flange, or tang 60 positioned within the handle mount channel 49. The tang 60 includes a first surface 61 which is configured to engage or contact the second stop wall 50 when the handle mount 54 is in its outwardly extending, unengaged position. The tang 60 also includes a second surface 62 opposite the first surface 61 which is configured to engage or contact the first stop wall 37 when the handle mount 54 is in an inwardly extending, engaged position.

The handle mount 54 also includes a handle mounting portion 65 having an elongated arm 66 and a handle bar opening 67. The arm 66 has a set screw mounting hole 69 which extends into the handle bar opening 67. A set screw 70 is threadably received within set screw mounting hole 69. The arm 66 of the handle mount 54 also includes a push rod hole, recess or receiver 73 facing the door D.

An elongated push rod 75 is positioned within the push rod channel C of the door D so as to extend through the push rod guide hole 40 of the support bracket extended portion 39. The push rod 75 has a first end 75' which is coupled to, contacts, or engages the latch push rod contact plate 21, and a second end 75" which is coupled to, contacts, or engages the handle mount 54 at the push rod receiver 73.

The second bar mount 31 is essentially of the same construction as the first bar mount 30 except for the support bracket 35. With the second bar mount 31, the support bracket 35 may not include the extended portion or plate 38, as the second bar mount 31 does not include or cooperate with an elongated push rod 75 coupled to the handle latch 12.

The elongated push bar 32 is coupled to and extends between the first and second bar mounts 30 and 31. The ends of the push bar 32 are positioned within the handle openings 67. The set screw 70 is threaded to engage and fix the position of the push bar 32 relative to the bar mounts 30 and 31. A cap 81 is fitted to the handle openings 67 to seal the openings and interior of the push bar 32.

In use, the exterior pull type handle latch 12 is mounted to the exterior surface of a door and the inside latch release 11 is mounted to the interior surface of the door D. The push rod 75 extends through the push rod channel C within the door thereby actuatingly or operably coupling the exterior handle latch 12 to the inside latch release 11.

To open the door D from the exterior of the cold room a person need only grasp the pivotal handle 16 of the handle latch 12 and pull it towards themselves or away from the door D. The actuation of the pivotal handle 16 moves the linkage 17 which thereby moves the latch bolt 18 to unlatch the door D.

To open the door D from the interior of the cold room a person may push anywhere on the elongated push bar 32, thereby pivoting the handle mounts 54 toward the door and to their engaged position. The pivoting of the handle mounts 54 causes the push rod 75 to be forced towards the exterior handle latch 12.

The contact of the end of the push rod 75 against the latch push rod contact plate 21 of the exterior handle latch 12 causes the pivotal handle 16 to move in a direction away from the door to its unlatched, unlocked or engaged position. This movement of the handle latch is essentially the same as if someone was directly pulling the pivotal handle 16 from the exterior side of the door. The movement of the pivotal handle 16 to its unlatched position unlatches the door D.

Once the latch release 11 is released by the person or operator, the coil spring 59 forces the handle mounts 54 and bar 32 to pivot about pivot pins 55 back to their initial, extended positions.

The contact between the tang first surface 61 against the second stop wall 50 prevents over extension of the handle mounts 54. Similarly, the contact between the tang second surface 62 and the first stop wall 37 provides a solid stopping point of the handle mounts 54 during inward movement or unlatching of the panic latch release assembly 10. These stops reduce wear and tear upon the latch components.

As shown, the panic bar latch assembly is coupleable to a door D and includes an exterior handle latch operable between a latched position latching the door and an unlatched position unlatching the door. The latch assembly also includes an interior latch release having a bar mount and an elongated push bar coupled to the bar mount for movement between an extended position and a retracted position. Lastly, the latch assembly includes a push rod extending through the door having a first end coupled to the exterior latch and a second end coupled to the interior latch release. With this construction, the movement of the interior latch release from the extended position to the retracted position causes the push rod to move towards the exterior latch thereby forcing the exterior latch (handle) to move from the latched position to the unlatched position.

It should be understood that the handle mount 54 may be considered to be either part of the bar mounts 30 and 31 or part of the elongated bar 32.

The advantage of the present system is that the interior push bar 32 provides a person with a highly recognizable latch release for a door. This is important when a person is under great duress or in a panicked mode.

Another advantage of the present system is that the elongated bar provides a large contact area for a person. This large contact area is important in providing greater leverage, the ability to place more than one hand on the handle release, and a large target area should the interior of the cold room have little or no interior light.

The interior latch release 11 is separate and apart from the exterior handle latch 12. Therefore, if the exterior handle latch is in need of replacement, it can be replaced without the need of also replacing the interior latch release 11, or visa-versa. Also, the interior latch release 11 does not include the linkage or mechanism necessary to move the latch bolt. This absence of the latch bolt and its linkage is an advantage over the prior art bar type latches which directly unlatch the door.

It should be understood that the pivoting motion of the elongated push bar or its handle mounts may be equated with a push bar which is pushed in a straight line rather than an arc.

It should be understood that as used herein the term pivotal handle, in reference to the exterior lever type pull handle 16 means that the handle pivots as it is being pulled by a person. The term pivotal handle does not include a handle which rotates as it is being operated. As such, the term pivotal handle does not include a rotating handle.

It should be understood that the foregoing descriptions merely relate to exemplary, illustrative embodiments of the invention. Therefore, it should also be understood that various modifications may be made to exemplary embodiments described herein that are within the scope of the invention, which will be recognized by one of ordinary skill in the art in light of the disclosure herein. Furthermore, various elements of the described exemplary embodiments of the invention may be known in the art or recognized by one of ordinary skill in the art based on the disclosure herein.

The invention claimed is:

1. A panic bar latch assembly coupleable to a door, the panic bar latch assembly comprising:

an exterior handle latch having a pivotal handle;

an interior latch release having two bar mounts coupled to the door, an elongated push bar extending between said two bar mounts, said elongated push bar being movably coupled to said two bar mounts, and, a push rod having a first end operatively coupled to said pivotal handle and an oppositely disposed second end operatively coupled to said push bar wherein movement of the push bar causes the push rod to pivotally bias the handle of the exterior handle latch.

2. The panic bar latch assembly of claim 1 wherein each said two bar mounts includes a support bracket and a body portion coupled to said support bracket, and wherein at least one said bar mount of said two bar mounts has an extended portion extending from said support bracket which has a push rod guide hole therethrough through which said push rod extends.

3. The panic bar latch assembly of claim 2 wherein each said support bracket has a first stop wall positioned to engage said push bar at a first position of said push bar, and wherein said body portion of each said bar mount includes a second stop wall positioned to engage said push bar at a second position of said push bar.

4. The panic bar latch assembly of claim 3 wherein said push bar includes two handle mounts, each handle mount being pivotally coupled to one said body portion, each handle mount having a tang positioned to engage said first stop wall and said second stop wall.

5. A panic bar assembly coupled to a door for engagement with an exterior latch having a pivotal pull handle, said panic bar assembly comprising:

an interior latch release mounted to the interior of the door, said interior latch release having:

a first bar mount with a first support bracket, a second bar mount with a second support bracket, wherein each of said first bar mount and said second bar mount has a support bracket, a body portion, and a pivotally coupled handle mount, and an elongated push bar coupled to and extending between said first handle mount and said second handle mount, and a push rod operatively extending between said first bar mount and the pivotal handle of the exterior latch.

6. The panic bar latch assembly of claim 5 wherein said first bar mount has an extended portion extending from said support bracket of said first bar mount which has a push rod guide hole therethrough through which said push rod extends.

7. The panic bar latch assembly of claim 5 wherein said first support bracket has a first stop wall positioned to engage said handle mount of said first bar mount at a first pivotal position of said handle mount of said first bar mount, and wherein said body portion of said first bar mount includes a second stop wall positioned to engage said handle mount of said first bar mount at a second pivotal position of said handle mount of said first bar mount.

8. The panic bar latch assembly of claim 5 wherein said second support bracket has a first stop wall positioned to engage said handle mount of said second bar mount at a first pivotal position of said handle mount of said second bar mount, and wherein said body portion of said second bar mount includes a second stop wall positioned to engage said handle mount of said second bar mount at a second pivotal position of said handle mount of said second bar mount.

9. The panic bar latch assembly of claim 7 wherein said handle mount of said first bar mount includes a first tang positioned to engage said first stop wall and said second stop wall.

10. The panic bar latch assembly of claim 9 wherein said handle mount of said second bar mount includes a second tang, wherein said support bracket of said second bar mount has a third stop wall positioned to engage said second tang at a first pivotal position of said handle mount of said second bar mount, and wherein said body portion of said second bar mount includes a fourth stop wall positioned to engage said second tang at a second pivotal position of said handle mount of said second bar mount.

11. A panic bar latch assembly coupleable to a door, the panic bar latch assembly comprising:

an exterior handle latch operable between a latched position latching the door and an unlatched position unlatching the door;

an interior latch release having two bar mounts and an elongated push bar coupled to said bar mount for movement between an extended position and a retracted position, wherein said elongated push bar extends between said two bar mounts;

a push rod extending through the door, said push rod having a first end coupled to said exterior handle latch and a second end coupled to said interior latch release wherein movement of said interior latch release from said extended position to said retracted position causes said push rod to move towards said exterior latch to force the exterior handle latch to move from said latched position to said unlatched position.

12. The panic bar latch assembly of claim 11 wherein said exterior handle latch includes a pivotal handle which is pivotal between a latched position latching the door and an unlatched position unlatching the door, and wherein said push rod first end is coupled to said pivotal handle.

13. The panic bar latch assembly of claim 11 wherein said elongated push bar is pivotally coupled to said two bar mounts.

14. The panic bar latch assembly of claim 11 wherein each said bar mount includes a support bracket and a body portion coupled to said support bracket, and wherein at least one of said bar mount of said two bar mounts has an extended portion extending from said support bracket which has a push rod guide hole therethrough through which said push rod extends.

15. The panic bar latch assembly of claim 14 wherein each said support bracket has a first stop wall positioned to engage said push bar at a first pivotal position of said push bar, and wherein said body portion of each said bar mount includes a second stop wall positioned to engage said push bar at a second pivotal position of said push bar.

16. The panic bar latch assembly of claim 15 wherein said push bar includes two handle mounts, each handle mount being pivotally coupled to one of said body portion, each handle mount having a tang positioned to engage said first stop wall and said second stop wall.

* * * * *